US006231176B1

(12) United States Patent
Peter

(10) Patent No.: US 6,231,176 B1
(45) Date of Patent: May 15, 2001

(54) SELF-TENSIONING FLEXIBLE HEATER ASSEMBLY FOR DRYING IMAGE BEARING SUBSTRATES IN AN INK JET PRINTER

(75) Inventor: Kenneth C. Peter, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/411,213

(22) Filed: Oct. 4, 1999

(51) Int. Cl.[7] ..... B41J 2/01
(52) U.S. Cl. ..... 347/102; 347/101; 347/104
(58) Field of Search ..... 347/102, 104, 347/101; 219/216, 520, 521, 522, 523

(56) References Cited

U.S. PATENT DOCUMENTS

| | | | | |
|---|---|---|---|---|
| 4,641,482 | * | 2/1987 | Metz | 53/388 |
| 4,982,207 | | 1/1991 | Tunmore et al. | 346/138 |
| 5,005,025 | | 4/1991 | Miyakawa et al. | 346/25 |
| 5,406,321 | | 4/1995 | Schwiebert et al. | 347/102 |
| 5,691,756 | * | 11/1997 | Rise et al. | 347/102 |
| 5,742,315 | * | 4/1998 | Szlucha et al. | 347/102 |

FOREIGN PATENT DOCUMENTS

| | | | | |
|---|---|---|---|---|
| 5-112000 | * | 5/1993 | (JP) | 347/102 |

* cited by examiner

*Primary Examiner*—John S. Hilten
*Assistant Examiner*—Minh H. Chau
(74) *Attorney, Agent, or Firm*—Tallam I. Nguti

(57) ABSTRACT

An ink jet printing machine for printing liquid ink images on a recording medium moving along a recording medium path through a printing zone. The printing machine includes a printhead for image-wise depositing liquid ink droplets on the recording medium, and a self-tensioning flexible heater assembly for heating the recording medium to dry the image-wise liquid ink droplets. The self-tensioning flexible heater assembly is disposed adjacently to the recording medium path, for heating the recording medium, and comprises a bowed resilient leaf spring forming a concave arc having a first end and a second end, and a flexible heating strip bonded to the first end and the second end across the concave arc, thereby providing self-tensioning and preventing wrinkling despite thermal expansion thereof.

6 Claims, 2 Drawing Sheets

SELF-TENSIONING FLEXIBLE HEATER ASSEMBLY FOR DRYING IMAGE BEARING SUBSTRATES IN AN INK JET PRINTER

BACKGROUND OF THE INVENTION

This invention relates generally to ink jet printing machines, and more particularly to a self-tensioning flexible heater assembly for drying of ink images deposited on a recording medium or substrate by a liquid ink printhead.

Liquid ink printers of the type frequently referred to as continuous stream or as drop-on-demand, such as piezoelectric, acoustic, phase change wax-based or thermal, have at least one printhead from which droplets of ink are directed towards a recording medium. Within the printhead, the ink is contained in a plurality of channels. Power pulses cause the droplets of ink to be expelled as required from orifices or nozzles at the end of the channels.

In a thermal ink-jet printer, the power pulse is usually produced by a heater transducer or a resistor, typically associated with one of the channels. Each resistor is individually addressable to heat and vaporize ink in the channels. As voltage is applied across a selected resistor, a vapor bubble grows in the associated channel and initially bulges from the channel orifice followed by collapse of the bubble. The ink within the channel then retracts and separates from the bulging ink thereby forming a droplet moving in a direction away from the channel orifice and towards the recording medium whereupon hitting the recording medium a dot or spot of ink is deposited. The channel is then refilled by capillary action, which, in turn, draws ink from a supply container of liquid ink.

The ink jet printhead may be incorporated into either a carriage type printer, a partial width array type printer, or a page-width type printer. The carriage type printer typically has a relatively small printhead containing the ink channels and nozzles. The printhead can be sealingly attached to a disposable ink supply cartridge. The combined printhead and cartridge assembly is attached to a carriage which is reciprocated to print one swath of information (equal to the length of a column of nozzles), at a time, on a stationary recording medium, such as paper or a transparency. After the swath is printed, the paper is stepped a distance equal to the height of the printed swath or a portion thereof, so that the next printed swath is contiguous or overlapping therewith. This procedure is repeated until the entire page is printed. In contrast, the page width printer includes a stationary printhead having a length sufficient to print across the width or length of a sheet of recording medium at a time. The recording medium is continually moved past the page width printhead in a direction substantially normal to the printhead length and at a constant or varying speed during the printing process.

Many liquid inks and particularly those used in thermal ink jet printing, include a colorant or dye and a liquid which is typically an aqueous liquid vehicle, such as water, and/or a low vapor pressure solvent. The ink is deposited on the substrate to form an image in the form of text and/or graphics. Once deposited, the liquid component is removed from the ink and the paper to fix the colorant to the substrate by either natural air drying or by active drying. In natural air drying, the liquid component of the ink deposited on the substrate is allowed to evaporate and to penetrate into the substrate naturally without mechanical assistance. In active drying, the recording medium is exposed to heat energy of various types which can include infrared heating, conductive heating and heating by microwave energy.

Active drying of the image can occur either during the imaging process or after the image has been made on the recording medium. In addition, the recording medium can be preheated before an image has been made to precondition the recording medium in preparation for the deposition of ink. Preconditioning of the recording medium typically prepares the recording medium for receiving ink by driving out excess moisture which can be present in a recording medium such as paper. Not only does this preconditioning step reduce the amount of time necessary to dry the ink once deposited on the recording medium, but this step also improves image quality by reducing paper cockle and curl which can result from too much moisture remaining in the recording medium.

Various drying mechanisms for drying images deposited on recording mediums are illustrated and described in the following disclosures which may be relevant to certain aspects of the present invention.

In U.S. Pat. No. 4,982,207, to Tunmore et al., a heater construction for an ink jet printer having a rotary print platen for holding and transporting a print sheet through a print path is described. The platen heater includes a hollow shell having vacuum holes for sheet attachment. A heating foil is detachably mounted in a heat transfer relation with the interior periphery of the shell.

U.S. Pat. No. 5,005,025, to Miyakawa et al., describes an ink jet recording apparatus for recording which fixes ink through evaporation of an ink solvent. The apparatus includes a heating member extending both upstream and downstream with respect to a recording area and a conveying direction of the recording sheet. The heating member contacts the recording sheet to assist in the fixation of the ink.

U.S. Pat. No. 5,406,321, to Schwiebert et al., describes an ink jet printer and a paper preconditioning preheater therefore. The paper preconditioning preheater has a curved surface and a multi-purpose paper path component to accomplish direction reversal for the paper. The paper contacts the preheater which dries and shrinks the paper to condition it for a printing operation. The preheater is a thin flexible film carrying heater elements which is suspended in air to provide extremely low thermal mass and eliminate the need for long warm up times.

Conventionally, these heaters in the form of a thick heater strip have been bonded uniformly and totally to an underlying structure or flat plate or suspended with complex external tensioning systems. The short falls of such conventional heaters include slow warm up times, due to high thermal mass, from start up or standby to the an effective drying temperature of about 250° F. Such slow warm up time ordinarily results in a need for a waiting period to achieve proper operation of the heater. The heater is thus not capable of reaching its operating temperature before paper or recording medium has fed from the supply tray to the print zone for printing to begin.

Other disadvantages include undesirable heatsinking or heating of other printer components due to conduction of heat away from the heater strip through its mounting structure. Wrinkling and or bowing of the heater surface due to thermal expansion mismatch with underlying structure are also problems.

SUMMARY OF THE INVENTION

In accordance with one aspect of the present invention, there is provided an ink jet printing machine for printing liquid ink images on a recording medium moving along a recording medium path through a printing zone. The printing machine includes a printhead for image-wise depositing liquid ink droplets on the recording medium, and a self-tensioning flexible heater assembly for heating the recording medium to dry the image-wise liquid ink droplets. The self-tensioning flexible heater assembly is disposed adjacently to the recording medium path, for heating the recording medium, and comprises a bowed resilient leaf spring forming a concave arc having a first end and a second end, and a flexible heating strip bonded to the first end and the second end across the concave arc, thereby providing self-tensioning and preventing wrinkling despite thermal expansion thereof.

BRIEF DESCRIPTION OF THE DRAWINGS

In the detailed description of the invention presented below, reference is made to the drawings in which.

DETAILED DESCRIPTION OF THE INVENTION

Figure 1:
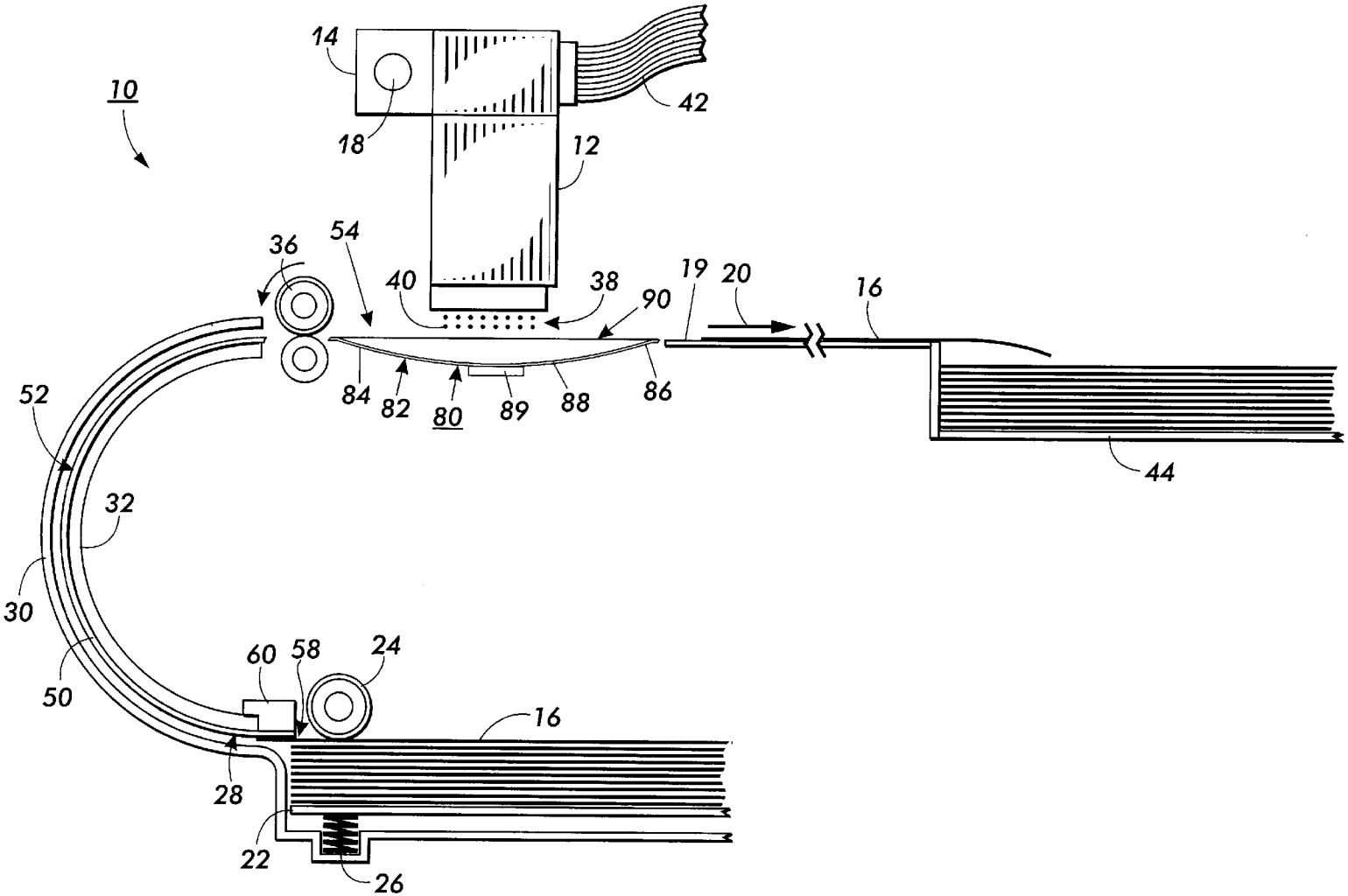
FIG. 1 is a schematic elevational side view of an ink jet printer showing a self-tensioning heater assembly in accordance with the present invention.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Although the present invention discussed herein may be used for drying any image which is created by a liquid ink printer, the description of the present invention will be described in the environment of an ink jet printer such as that shown in the Figure. The Figure illustrates a schematic representation of a thermal ink jet printer 10 in a side elevation view. A translating ink jet printhead 12 printing black and/or colored inks is supported by a carriage 14 which moves back and forth on a guide rail 18, across a recording medium 16, such as a sheet of paper or a transparency.

Multiple printheads printing different colors are also within the scope of this invention. The recording medium 16 is moved along a recording medium path 19 through the printer in the direction noted by the arrow 20. Single sheets of the recording medium 16 are fed from a tray 22 by a document feed roll 24. The document tray 22 is spring biased by a biasing mechanism 26 which forces the top sheet of the stack of recording sheets held by the tray 22 into contact with the feed roll 24. A top recording medium 16 in contact with the drive roll 24 is transported by the drive roll 24 into a chute 28 which is defined by an outer guide member 30 spaced from an inner guide member 32, each of which are curved to thereby reverse the direction of the recording sheets 16 for printing by the printhead 12. Once the recording medium exits the chute 28, the recording medium 16 is driven into the nip of a drive roll 34 cooperating with a pinch roll 36 to advance the recording sheet 16 into a printing zone 38.

The printing zone 38 is the area directly beneath the printhead 12 where droplets of ink 40 are deposited by an array of ink nozzles printing a swath of information and arranged on a front face of the printhead. The front face of the printhead is substantially parallel to the recording medium. The carriage 14, traveling orthogonally to the recording medium 16, deposits the ink droplets 40 upon the recording medium 16 in an image-wise fashion.

The printhead 12 receives ink from either an attached ink tank or from an ink supply tube (not shown). The image deposited upon the recording medium 16 can include text and/or graphic images, the creation of which is controlled by a controller, known to those skilled in the art, in response to electrical signals traveling through a ribbon cable 42 coupled to the printhead 12. Before the recording medium 16 has completely left control of the drive roll 34 and the pinch roll 36, an exit drive roll/pinch roll combination (not shown) or other known means captures the leading edge of the recording medium 16 for transport to an output tray 44 which holds printed recording medium.

Thermal ink jet printing image quality benefits from heat applied to the printing substrate prior to and during the printing process. Removal of ambient moisture and heating of the substrate before and during printing causes ink to penetrate the substrate quickly and minimizes the length of time that ink resides on the surface in a puddle. Ink will then penetrate down into the substrate instead of across the surface. This results in improvements in print quality due to reduced spot size, line width and inter-color bleed. Removal of most ambient moisture from the substrate prior to printing is necessary to assure dimensional stability during the printing process.

Therefore to dry and fix the liquid ink droplets on the recording medium 16 in order to prevent smearing defects, moisture which makes the ink liquid must be driven the ink droplets. While it is possible to dry the ink droplets by natural air drying, natural air drying can create certain problems such as cockle or curl and can also reduce the printing throughput of the printer. Consequently, active drying by the application of heat energy to the printed recording medium 16 is preferred, such heat energy is provided effectively by heating assemblies including the self-tensioning heater assembly 80 of the present invention.

The heating assemblies for example include a first heating assembly 50 that is located in a first heating area 52, along the inside of the chute 28, in contact with and supported by the inner guide section 32, and extends to just about the start of the printing zone 38. The first heating assembly 50 is located within the chute 28 such that the side of the recording medium opposite the side to be printed on comes into direct contact with the heating assembly 50. Heat energy is delivered primarily through contact and conduction. The inner guide section 32 can include apertures, such as round holes, diagonally placed slots, or raised areas to aid in shortening warm-up times.

Thus, the first heating assembly 50 forms a preheating or first heating area 52 for preheating the recording medium or paper 16 before it enters the printing zone 38. As further shown, the printer 10 includes a second heating area 54 that is coincident with the printing zone 38 so as to effectively apply heat energy to the backside of the recording medium 16 during printing. To be effective, a heating assembly used within this second heating area 54 must be as flat as possible even given thermal expansion thereof from the heat energy being generated therein, in order to provide a uniform contact surface for supporting the backside of the recording medium 16 in the printing zone 38 during printing. Surface flatness is required to insure adequate paper to heater contact as well as to maintain the critical spacing between the printhead 12 and the recording medium.

Figure 2:
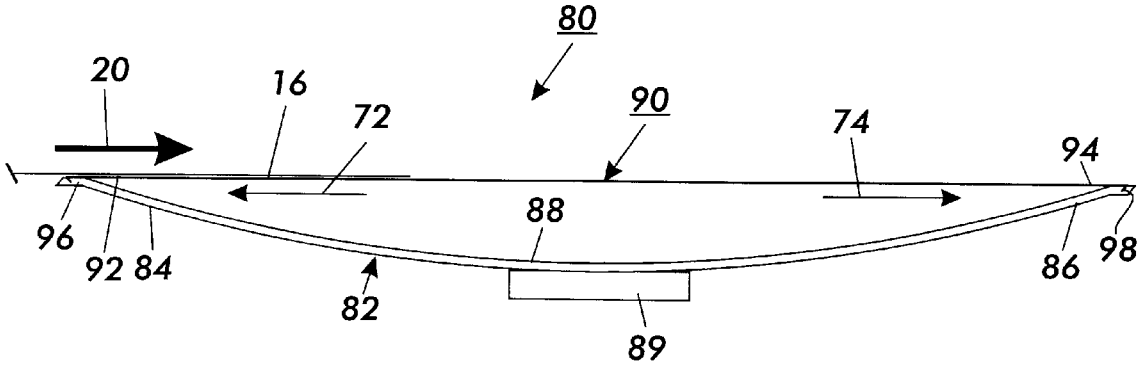
FIG. 2 is and enlarged illustration of the self-tensioning heater assembly in accordance with the present invention.

As illustrated, such effective contact and heating in the second heating area 54 is provided by the self-tensioning heater assembly 80 of the present invention. As shown in FIGS. 1 and 2, the self-tensioning heater assembly 80 includes a leaf spring member 82 having a first end 84, a second end 86, and a deflected concave arc portion 88 that lies between the first end 84 and the second end 86. The leaf-spring member 82 for example can be supported operationally within the second heating area 54 by a bracket 89 that is located equidistantly between its ends and against the concave arc portion 88 as shown.

The self-tensioning heater assembly 80 also includes a flat heating member 90 having a first edge 92 and a second edge 94. The flat heating member 90 is stretched across the deflected concave arc 88 of the leaf spring member 82 from the first end 84 to the second 86 thereof. The first edge 92 and the second edge 94 of the flat heating member 90 are bonded at points 96 and 98 respectively to the first end 84 and the second end 86, respectively, of the leaf spring member as shown. Such bonding causes the concave or bowed leaf spring member under tension, as shown by the arrows 72 and 74, to produce self-tensioning in the flat heating member 90 between the first end 84 and the second end 86 thereof, thereby insuring flatness of the heating member 90 and maximized uniform contact between the flat heating member and the recording medium 16.

Preferably, the leaf spring member 82 is made of fiberglass, and the flat heating member 90 includes electrically conductive strips extending from the first edge 92 to the second edge 94 thereof. Although fiber glass is preferred, the leaf spring member can equally be any resilient sheet member other than fiberglass. In operation, the leaf spring member 82 or resilient sheet member produces tension along the length of the heater strip—and thus allows the far ends or edges 84, 86 of the heater strip 90 to move apart due to thermal expansion, while maintaining a flat surface.

Specifically, the heating strip or member 90 is a thin (about 0.007") heater strip. The mounted technique of bonding just its first and second ends 84, 86 (that is upstream and downstream edges relative to movement of the recording medium 16) advantageously minimizes heat loss (heat sinking) from the heating member or strip 90 to the mount (leaf spring member 82) or other parts of the printer 10. The bowed leaf spring member 82 applies a continuous tension on the heater strip 90 in order to prevent it from wrinkling due to thermal expansion.

As can be seen, there has been provided an ink jet printing machine for printing liquid ink images on a recording medium moving along a recording medium path through a printing zone. The printing machine includes a printhead for image-wise depositing liquid ink droplets on the recording medium, and a self-tensioning flexible heater assembly for heating the recording medium to dry the image-wise liquid ink droplets. The self-tensioning flexible heater assembly is disposed adjacently to the recording medium path, for heating the recording medium, and comprises a bowed resilient leaf spring forming a concave arc having a first end and a second end, and a flexible heating strip bonded to the first end and the second end across the concave arc, thereby providing self-tensioning and preventing wrinkling despite thermal expansion thereof.

While this invention has been described in conjunction with a particular embodiment thereof, it shall be evident that many alternatives, modifications and variations will be apparent to those skilled in the art. Accordingly, the present invention is intended to embrace all such alternatives, modifications and variations as fall within the spirit and broad scope of the appended claims.

What is claimed is:

1. A heater assembly for drying ink images on a recording medium, the heater assembly comprising:

(a) a leaf spring member having a first end, a second end, and a deflected concave arc portion between said first end and said second end; and (b) a flat heating member having a first edge and a second edge, said flat heating member being suspended across said deflected concave arc from said first end to said second thereof, and said first edge and said second edge of said flat heating member being bonded to said first end and said second end, respectively, of said leaf spring member for producing self-tensioning in said flat heating member between said first end and said second of said leaf spring member, thereby insuring maximized uniform contact between said flat heating member and the recording medium.

2. The heater assembly of claim 1, wherein said flat spring member is made of fiberglass.

3. The heater assembly of claim 1, wherein said flat heating member includes electrically conductive strips extending from said first edge to said second edge thereof.

4. An ink jet printing machine for printing liquid ink images on a recording medium moving along a recording medium path through a printing zone, comprising:

(a) a frame;

(b) a printhead mounted to said frame and containing liquid ink for depositing image-wise onto the recording medium to form ink images; and (c) a heater assembly mounted to said frame along the recording medium path for drying the ink images on the recording medium, the heater assembly comprising:

(i) a leaf spring member having a first end, a second end, and a deflected concave arc portion connecting said first end and said second end; and (ii) a flat heating member having a first edge and a second edge, said flat heating member being suspended across said deflected concave arc from said first end to said second thereof, and said first edge and said second edge of said flat heating member being bonded to said first end and said second end, respectively, of said leaf spring member for producing self-tensioning in said flat heating member between said first end and said second of said leaf spring member, thereby insuring maximized uniform contact between said flat heating member and the recording medium.

5. The printing machine of claim 4, wherein said heater assembly is mounted along the recording medium path within the printing zone.

6. The printing machine of claim 4, further attaching means for attaching said deflected concave arc portion of said leaf spring member to said frame so as to allow said first end and said second end thereof to freely pull oppositely on said flat heating member.

* * * * *